United States Patent [19]

Wright

[11] Patent Number: 4,867,606

[45] **Date of Patent: * Sep. 19, 1989**

[54] TAMPER ATTACHMENT FOR VIBRATORY PLOW AND METHOD OF LAYING LINE AND CABLE

[76] Inventor: Alvin K. Wright, Rte. 14, Box 580, Hickory, N.C. 28601

[ * ] Notice: The portion of the term of this patent subsequent to Dec. 13, 2005 has been disclaimed.

[21] Appl. No.: 208,743

[22] Filed: Jun. 17, 1988

Related U.S. Application Data

[63] Continuation-in-part of Ser. No. 103,903, Oct. 2, 1987, Pat. No. 4,790,687.

[51] Int. Cl.[4] ..... E02F 5/00

[52] U.S. Cl. ..... 405/182; 405/271; 404/117; 404/133; 37/DIG. 18; 172/40

[58] Field of Search ..... 405/182, 404, 172, 37; 404/102, 133, 103, 117, 121; 172/40, 63, 497, 500; 37/DIG. 18

[56] References Cited

U.S. PATENT DOCUMENTS

| | | | |
|---|---|---|---|
| 3,236,164 | 2/1966 | Miller | 404/133 |
| 3,277,801 | 10/1966 | Horvath et al. | 404/133 |
| 3,308,729 | 3/1967 | Kestel | 404/133 |
| 3,498,384 | 3/1970 | Ogura | 404/102 X |
| 3,699,693 | 10/1972 | Nelkin | 405/182 |
| 3,747,357 | 7/1973 | Erickson et al. | 405/182 |
| 3,802,791 | 4/1974 | Uebel et al. | 404/133 |
| 3,838,933 | 10/1974 | Lehman et al. | 404/117 |
| 3,908,292 | 9/1975 | Harris | 37/142.5 |
| 4,104,001 | 8/1978 | Uebel | 404/133 |
| 4,170,427 | 10/1979 | Grane | 404/133 |
| 4,367,054 | 1/1983 | Salani et al. | 404/117 |
| 4,439,057 | 3/1984 | Sprague | 404/133 |
| 4,790,687 | 12/1988 | Wright | 405/182 |

*Primary Examiner*—Randolph A. Reese
*Assistant Examiner*—J. Russell McBee
*Attorney, Agent, or Firm*—W. Thad Adams, III

[57] ABSTRACT

A tamper attachment for a vibratory plow vehicle of the type wherein a vibrator imparts vibrations to a plow which is used to plow a narrow, relatively shallow furrow to receive a line or cable. The tamper attachment comprises attachment means for attaching the tamper to the vibrating means of the plow and a housing fixedly secured to the attachment means. A tamper foot comprising a cylindrical roller is positioned below the housing in ground contacting relation for rapidly impacting the ground in response to vibrations transmitted by the vibratory means for closing and tamping the furrow opened by the vibratory plow. A pair of spaced apart, spring loaded tamper foot guide arms are connected to the tamper foot and are slidably mounted in the housing for transmitting rapid up and down movement from the vibrating means through the housing to the tamper foot. A tamper adjustment arm is connected to the tamper foot and mounted in the housing for limiting reciprocatory movement of the tamper foot guide arms. A method of laying cable using the tamper is also disclosed.

12 Claims, 5 Drawing Sheets

TAMPER ATTACHMENT FOR VIBRATORY PLOW AND METHOD OF LAYING LINE AND CABLE

This application is a continuation-in-part of patent application Ser. No. 103,903, filed on Oct. 2, 1987 and now issued as U.S. Pat. No. 4,790,687.

TECHNICAL FIELD AND BACKGROUND OF THE INVENTION

This invention relates to a tamper attachment for a vibratory plow. A vibratory plow is a type of plow which is used to dig a relatively narrow, shallow, straight-sided furrow into which is fed a line or cable. The plow has a blade which is pulled through the ground by a small tractor or other vehicle. A vibrator transmits low amplitude, high frequency vibrations to the plow. The efficiency of the plow is greatly increased, since the power applied to the plow is independent of the amplitude of the vibration. The vibration greatly increases the ability of the plow to cut cleanly through the ground.

The line may be a small hose or pipe, or an electric line. The cable very often comprises a coaxial cable of the type used to transmit electronic signals, such as television audio and video signals. When extending cable television service into new areas, the signal transmission cables are buried when it is not possible or desirable to string the cable from power or telephone lines.

Heretofore, the furrow is filled manually by workers with shovels, or by a manually operated, separate tamper powered by compressed air or a small gasoline engine. This requires additional workers and equipment and is therefore very inefficient.

SUMMARY OF THE INVENTION

Therefore, it is an object of the invention to provide a tamper attachment for a vibratory plow.

It is another object of the invention to provide a tamper which automatically tamps closed a furrow after a line or cable has been laid in the furrow.

It is another object of the invention to provide a tamper which vibrates in unison with the plow to close the furrow formed by the plow after a line or cable has been laid in the furrow.

It is another object of the invention to provide a method of laying line or cable in the ground.

These and other objects of the present invention are achieved in the preferred embodiments disclosed below by providing a tamper attachment for a vibratory plow vehicle of the type wherein a vibrator imparts vibrations to a plow which is used to plow a narrow, relatively shallow furrow to receive a line or cable. The tamper attachment comprises attachment means for attaching the tamper to the vibrating means of the plow and a housing fixedly secured to the attachment means. A tamper foot is positioned below the housing in ground contacting relation for rapidly impacting the ground in response to vibrations transmitted by the vibratory means for closing and tampering the furrow opened by the vibratory plow.

A pair of spaced-apart, spring loaded tamper foot guide arms are connected to the tamper foot and are slidably mounted in the housing for transmitting rapid up and down movement from the vibrating means through the housing to the tamper foot. A tamper adjustment arm is connected to the tamper foot and mounted in the housing for limiting reciprocatory movement of the tamper foot guide arms.

According to one preferred embodiment of the invention, the tamper defines a cylindrical roller.

According to one preferred embodiment of the invention, the pair of tamper foot guide arms define planar sides and are each slidably mounted in the housing by means of a pair of opposed roller bearings.

According to another preferred embodiment of the invention, the tamper foot guide arms are each slidably mounted in the housing by a first pair of opposed roller bearings and a second pair of opposed roller bearings vertically spaced-apart from the first pair of roller bearings.

According to yet another embodiment of the invention, the first and second pairs of roller bearings are mounted in a tamper guide housing carried by the housing.

Preferably, the foot guide arms and the tamper adjustment arm are mounted in mutual vertical coaxial alignment with each other.

In accordance with the method of the invention, the invention comprises the steps of attaching a plow to a vehicle for being pulled through the ground to form a relatively narrow, shallow furrow and attaching a tamper to the vehicle directly behind the plow to close the furrow. Then, a line or cable is laid into the furrow behind the plow and in front of the tamper. The tamper is vibrated to facilitate operation thereof.

Preferably, the invention includes the step of spring loading the tamper to provide spring-assisted impact by the tamper to the ground.

According to another preferred embodiment of the invention, both the plow and the tamper are vibrated by the same vibrator.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
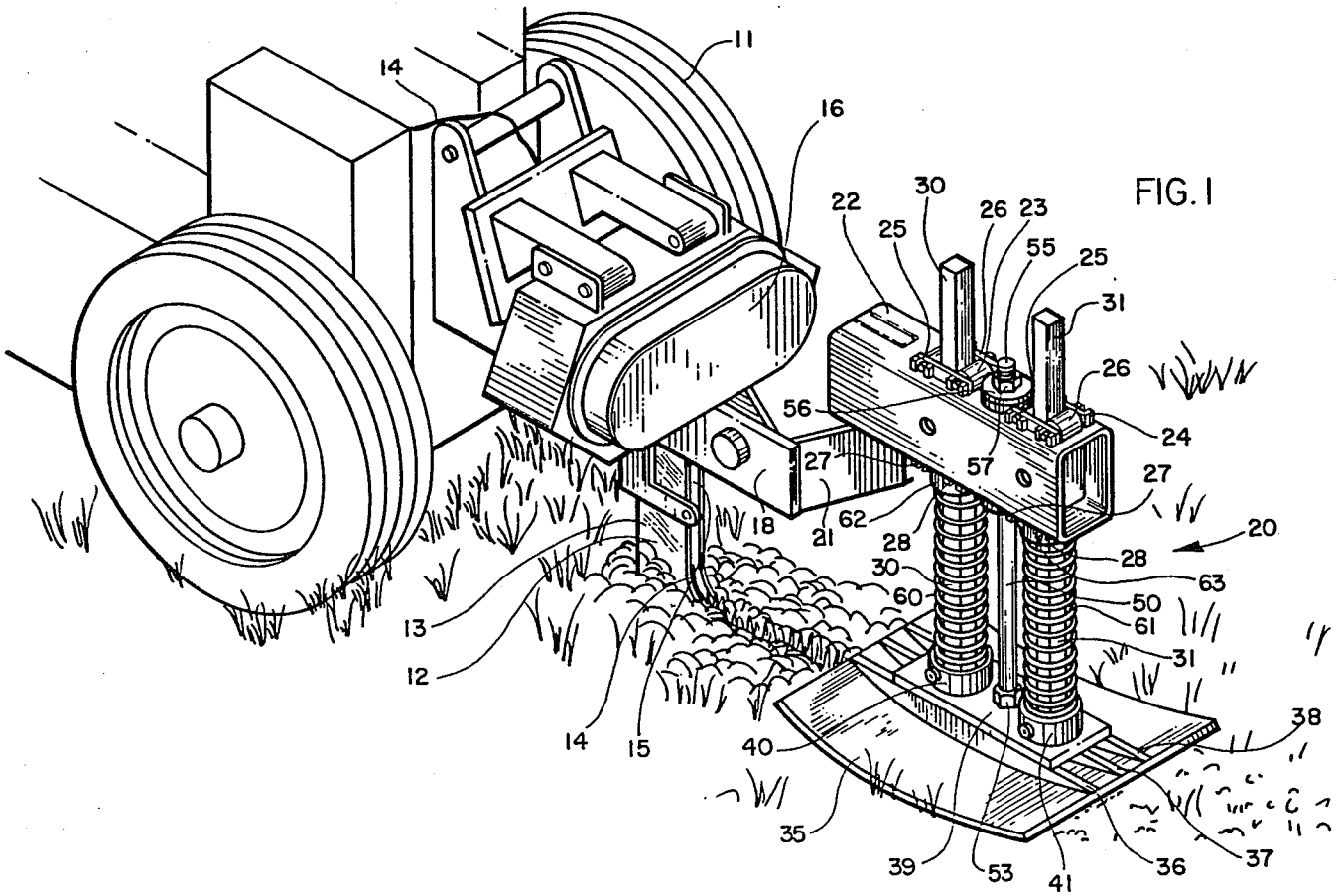
FIG. 1 is a perspective, environmental view of the vibratory plow and tamper attachment according to the invention.

Referring now specifically to the drawings, a vibratory plow with tamper attachment according to the present invention is illustrated in FIG. 1 and shown generally at reference numeral 10. Use of the term vibratory plow 10 refers to the combination of a small tractor 11 or similar vehicle which pulls a small plow blade 12. Plow blade 12 has a sharp forward edge 13 which knifed through the ground. The only purpose of the plow blade 12 is to form a narrow, relatively shallow furrow into which a cable 14, such as a coaxial communications cable, is laid. For this purpose, the back side of plow blade 12 defines a channel 15 through which cable 14 is fed.

A vibrator 16 which is carried by the tractor 11 is mounted directly onto plow blade 12 and provides vibratory impact.

A mounting brace 18 is carried by plow blade 12 and is used to attach a tamper 20 according to the invention. As is shown in FIG. 1, tamper 20 is mounted behind plow blade 12 and closes the furrow after cable 14 is laid.

Tamper 20 comprises an attachment beam 21 on which is mounted a housing 22. Housing 22 is formed of a steel pipe which is substantially square in cross-section and into which is mounted a pair of spaced-apart tamper guide housings 23 and 24 fitted into suitably-formed openings in housing 22.

Figure 3:
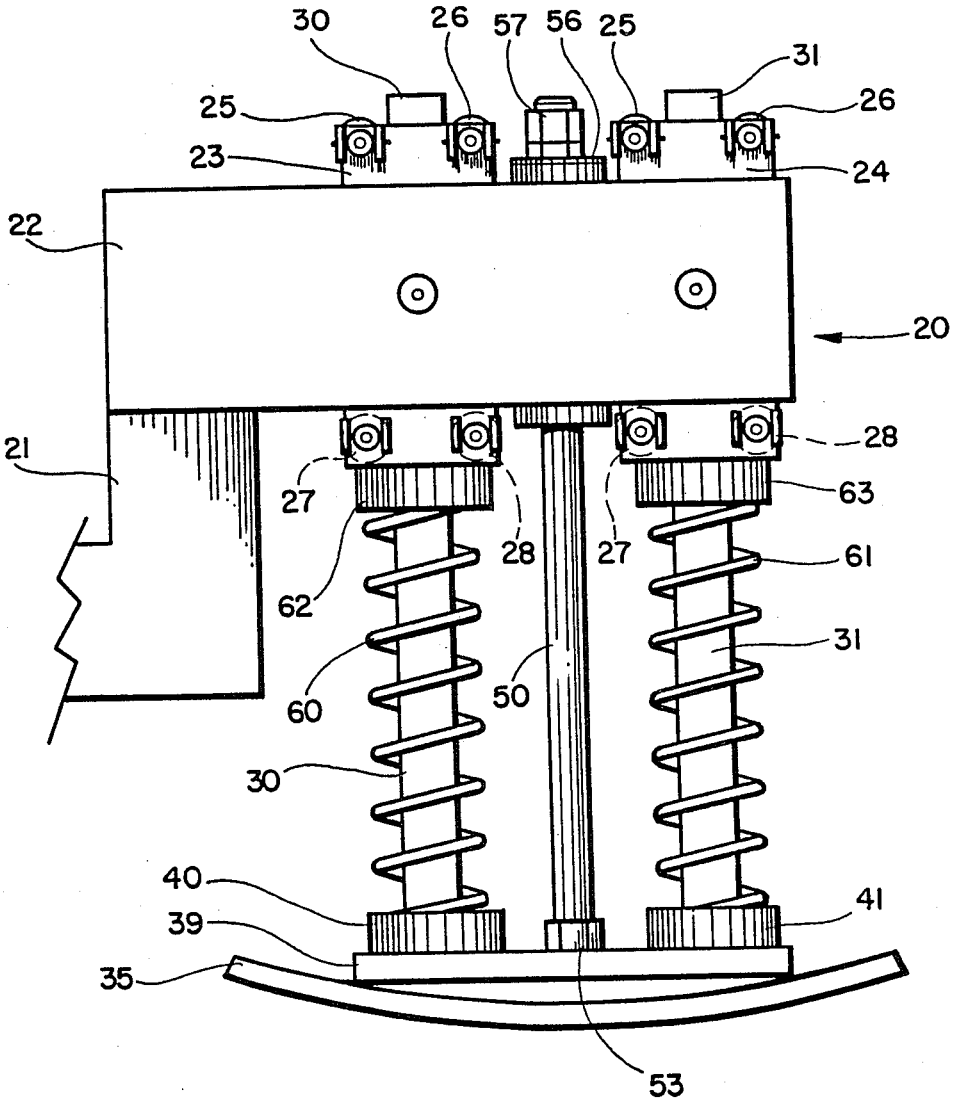
FIG. 3 is a elevation view of the tamper.

As is best shown in FIG. 3, each tamper guide housing 23 or 24 comprises an upper pair of spaced-apart, opposed roller bearings 25, 26 mounted on the top of housing 22 and a lower pair of spaced-apart, opposed roller bearings, 27, 28 mounted directly beneath upper roller bearings 25, 26 on the bottom of housing 22. The horizontal and vertical spaces between the roller bearings define a channel into which is positioned tamper guide arms 30, 31, respectively. Tamper guide arms 30, 31 have opposing planar sides and reciprocate up and down within tamper guide housings 23 and 24, respectively on the roller bearings.

Figure 2:
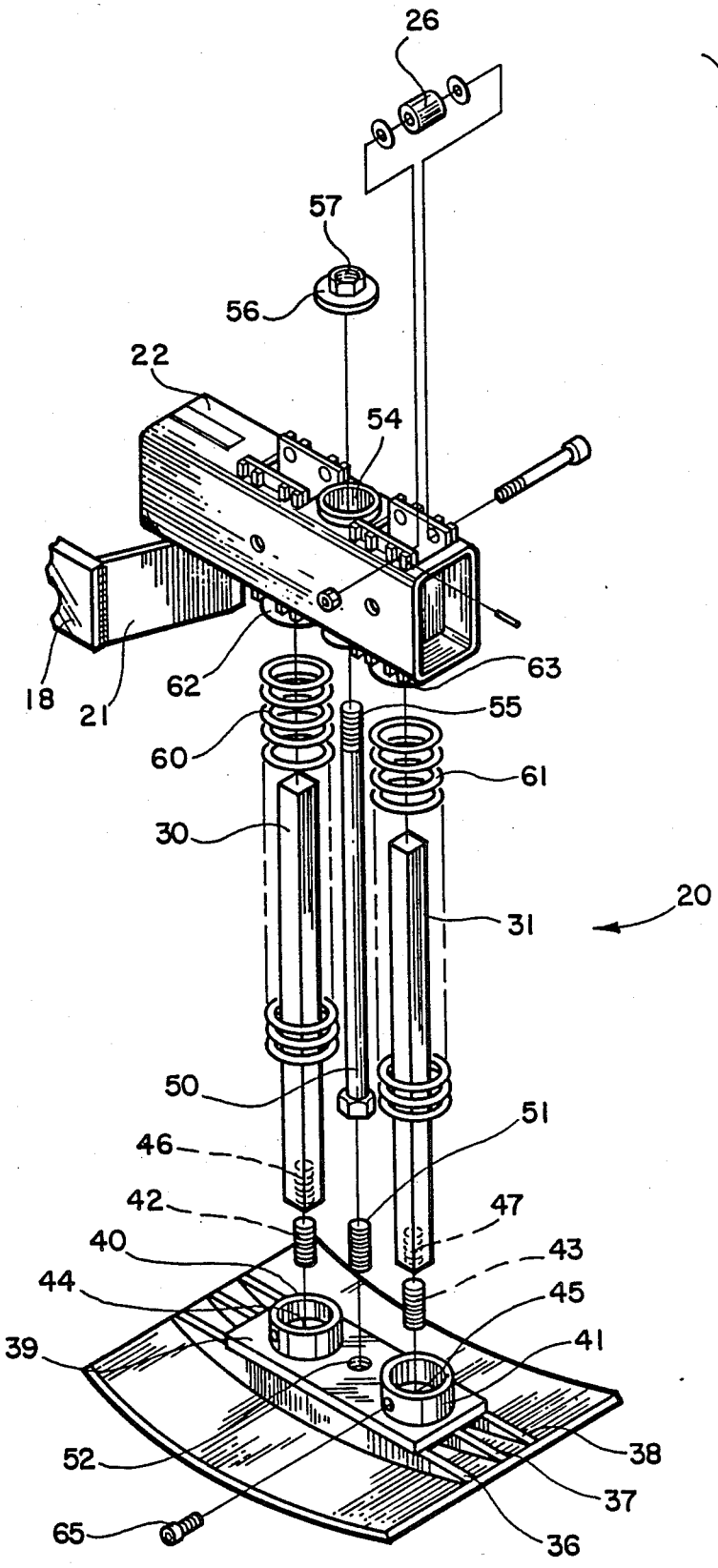
FIG. 2 is an exploded view of the tamper.

Referring now to FIG. 2, tamper guide arms 30, 31 are each secured by a respective lower end to a tamper foot 35, which is curved front-to-back. Three curved spacers 36, 37 and 38 on the inner face of the tamper 35 support a mounting plate 39 on which is positioned a pair of collars 40, 41. Threaded bolts 42, 43 are received into suitably threaded holes 44, 45 in mounting plate 39 and also in suitably threaded holes 46, 47 in the bottomend of tamper guide arms 30, 31, respectively. Bolts 42, 43 hold the tamper guide arms in fixed relation to the tamper foot 35. Lock nuts are not required, since the tamper guide arms are both square and are prevented from turning by their engagemetn with the respective roller bearings 25, 26 and 27, 28.

By continued reference to FIG. 2, a tamper adjustment arm 50 is shown also fixed to tamper foot 35 by a bolt 51. One end of bolt 51 is positioned in a threaded hols 52 in mounting plate 39 between collars 40, 41. The other end of bolt 51 is threaded into a hole (not shown) in the bottom end of tamper adjustment arm 50. A lock nut 53 prevents tamper adjustment arm 50 from loosening.

The upper end of tamper adjustment arm 50 is positioned in an oversized hole 54 in housing 22 between tamper guide arms 30 and 31. Threads 55 on the upper end of tamper adjustment arm 50 receive a washer 56 and lock nut 57.

Coil springs 60 and 61 are mounted in concentric relation on tamper guide arms 30 and 31, respectively. The lower end of springs 60 and 61 are mounted in collars 40, 41, and their upper ends are mounted in collars 62 and 63 secured to the bottom of housing 22 in surrounding relation to the roller bearing channels in which the tamper guide arms 30 and 31 reciprocate. Springs 60 and 61 are held in collars 40, 41, respectively, by locking screws 65.

By adjustment of the lock nut 57, the maximum distance between the housing 22 and tamper foot 35 is defined, thereby limiting the amplitude of the up and down movement of the tamper foot 35. Tightening lock nut 57 increases compression of springs 60, 61 and therefore the stored energy in the springs.

During operation, vibration from vibrator 16 is transmitted to tamper 20 through the mounting brace 18 and attachment beam 21 to housing 22. Downward movement of housing 22 causes a relative upward movement of tamper guide arms 30, 31 which compresses springs 60, 61. Energy stored in springs 60, 61 is released as downward movement to tamper guide arms 30, 31. Upward movement of housing 22 causes a relative downward movement of tamper guide arms 30, 31, which movement is cumulative to the downward movement of tamper guide arms 30, 31 caused by the springs 60, 61. The combined force is sufficient to tightly compact the earth to fill in the furrow.

Downward travel of the tamper foot 35 is arrested by lock nut 57 and washer 56. Upward travel of the tamper foot 35 is arrested by the compression of the springs 60, 61.

Figure 4:
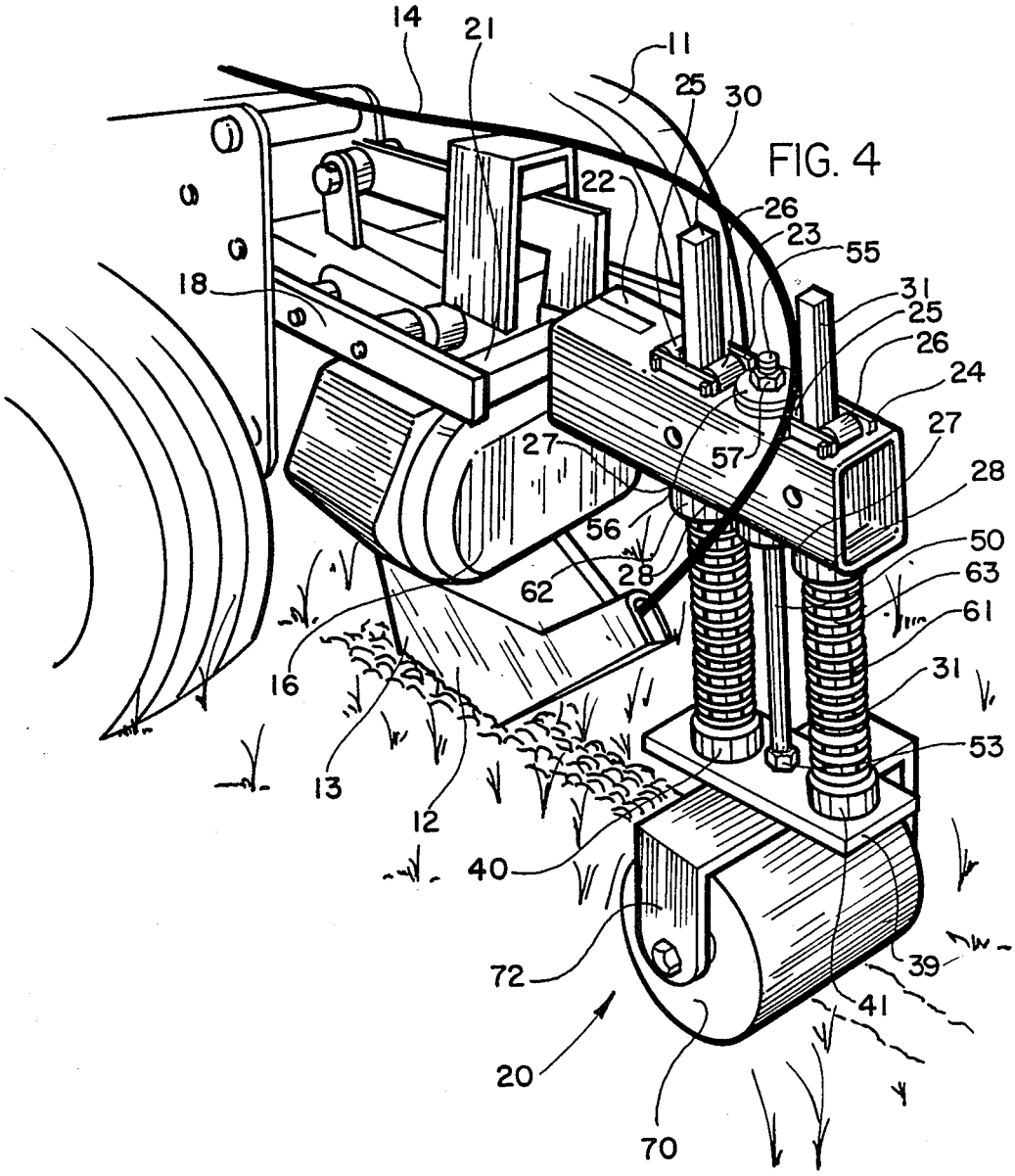
FIG. 4 is a perspective view of the vibratory plow and tamper attachment according to an embodiment of the invention wherein the tamper foot comprises a roller.
Figure 5:
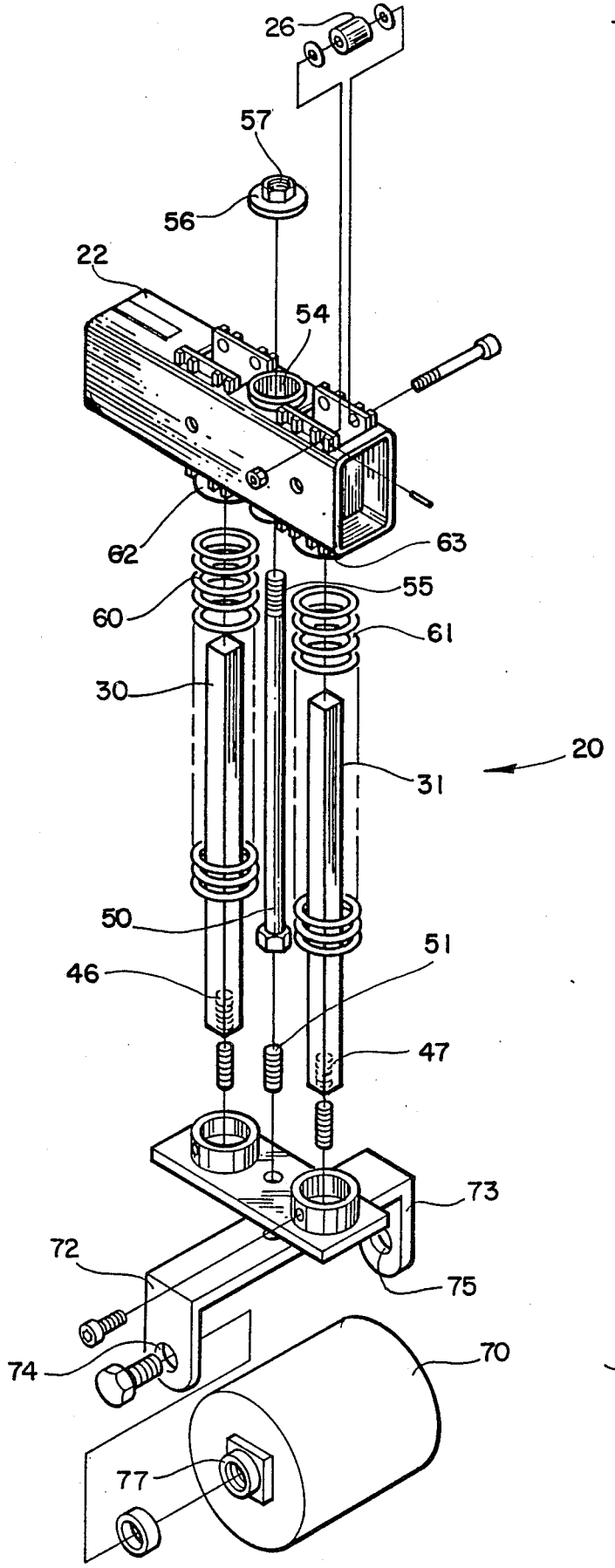
FIG. 5 is an exploded view of the tamper illustrated in FIG. 4.

An alternative embodiment of the vibratory plow is shown in FIGS. 4 and 5 and indicated at reference numeral 10'. The tamper attachment is illustrated in FIGS. 4 and 5, and is broadly indicated at reference numeral 20'. Elements the same or functionally equivalent to the elements identified above with reference to FIGS. 1–3 are indicated with prime notation.

As is shown in FIG. 4, the tamper foot comprises a heavy steel cylindrical roller 70 mounted for rotation in an axle bracket 71 mounted to the bottom of mounting plate 39'. Downwardly extending axle arms 72, 73 in axle bracket 71 have holes 74, 75 therein, respectively, through which extend axle studs 76 (one shown). Axle studs 76 are received in mounting collars 77 (one shown) on opposite ends of roller 70. Roller 79 rotated by frictional engagement with the ground as the vibratory plow moves forward.

The low amplitude of vibration permits a high frequency of up and down movement which enables the soil to be compacted to a greater density. As is known, vibration imparted to dirt or soil permits the individual particles to settle and shft until a very tight, dense compaction is obtained.

A tamper attachment for a vibratory plow and a method of laying line or cable is described above. Various details of the invention may be changed without departing from its scope. Furthermore, the foregoing description of the preferred embodiment according to the present invention is provided for the purpose of illustration only and not for the prpose of limitation-the invention being defined by the claims.

I claim:

1. A tamper attachmetn for a vibratory plow vehicle of the type wherein vibrating means imparts vibration to a plow which is used to plow a narrow, relatively shallow furrow to receive a line or cable, said tamper attachment comprising:

(a) attachment means for attaching the tamper attachment to the vibrating means of the plow rearwardly of where the furrow is plowed;

(b) a housing fixedly secured to said attachment means;

(c) a tamper foot positioned below said housing in ground contacting relation for rapidly impacting the ground in response to vibrations transmitted by said vibrating means for closing and tamping the furrow opened by the vibratory plow, said tamper foot comprising a roller;

(d) a pair of spaced apart, spring loaded tamper foot guide arms connected to said tamper foot and slidably mounted in said housing for transmitting rapid up and down movement from the vibrating means through the housing to the tamper foot; and (e) a tamper adjustment arm connected to said tamper foot and mounted in said housing for controlling the amplitude of reciprocatory movement of the tamper foot guide arms.

2. A tamper attachment according to claim 1, wherein said roller defines a cylinder mounted for rotation on an axis perpendicular to the direction of the furrow made by the plow.

3. A tamper attachment according to claim 1, wherein said pair of tamper foot guide arms define planar sides and are each slidably mounted in said housing by means of a pair of opposed roller bearings.

4. A tamper attachment according to claim 3, wherein said tamper foot guide arms are each slidably mounted in said housing by a first pair of opposed roller bearings and a second pair of opposed roller bearings vertically spaced-apart from said first pair of roller bearings.

5. A tamper attachment according to claim 4, wherein said first and second pairs of roller bearings are mounted in a tamper guide housing carried by said housing.

6. A tamper attachment according to claim 1, wherein said tamper foot guide arms and said tamper adjustment arm are mounted in mutual vertical parallel alignment with each other.

7. A tamper for closing a narrow, relatively shallow furrow of the type formed in the ground by a plow to receive line or cable, said tamper comprising:

(a) vibratory means;

(b) a housing fixedly secured to said vibratory means;

(c) a tamper foot position below said housing in ground contacting relation for rapidly impacting the ground in response to vibrations transmitted by said vibratory means for closing and tamping the furrow, said tamper foot comprising a roller;

(d) a pair of spaced apart, spring loaded tamper foot guide arms connected to said tamper foot and slidably mounted in said housing for transmitting rapid up and down movement from the vibrating means through the housing to the tamper foot; and (e) a tamper adjustment arm connected to said tamper foot and mounted in said housing for adjustably tensioning the spring loaded guide arms for limiting reciprocatory movement of the tamper foot guide arms.

8. A tamper according to claim 7, wherein said tamper foot defines a cylinder mounted for rotation on an axis perpendicular to the direction of the furrow made by the plow.

9. A tamper according to claim 7, wherein said pair of tamper foot guide arms define planar sides and are each slidably mounted in said housing by means of a pair of opposed roller bearings.

10. A tamper according to claim 9, wherein said tamper foot guide arms are each slidably mounted in said housing by a first pair of opposed roller bearings and a second pair of opposed roller bearings vertically spaced-apart from said first pair of roller bearings.

11. A tamper according to claim 10, wherein said first and second pairs of roller bearings are mounted in a tamper guide housing carried by said housing.

12. A tamper according to claim 7, wherein said tamper foot guide arms and said tamper adjustment arm are mounted in mutual vertical parallel alignment with each other.

* * * * *